US007591914B2

(12) United States Patent
Toyooka et al.

(10) Patent No.: US 7,591,914 B2
(45) Date of Patent: Sep. 22, 2009

(54) HIGH-WORKABILITY STEEL PIPE AND METHOD OF PRODUCING SAME

(75) Inventors: Takaaki Toyooka, Handa (JP); Yoshikazu Kawabata, Handa (JP); Akira Yorifuji, Handa (JP); Masanori Nishimori, Handa (JP); Motoaki Itadani, Handa (JP); Takatoshi Okabe, Handa (JP); Masatoshi Aratani, Handa (JP)

(73) Assignee: JFE Steel Corporation (JP)

( * ) Notice: Subject to any disclaimer, the term of this patent is extended or adjusted under 35 U.S.C. 154(b) by 0 days.

(21) Appl. No.: 10/258,982

(22) PCT Filed: Jun. 14, 2001

(86) PCT No.: PCT/JP01/05053

§ 371 (c)(1),
(2), (4) Date: Oct. 30, 2002

(87) PCT Pub. No.: WO02/103069

PCT Pub. Date: Dec. 27, 2002

(65) Prior Publication Data

US 2003/0145913 A1 Aug. 7, 2003

(51) Int. Cl.
*C21D 9/08* (2006.01)
*C22C 38/00* (2006.01)

(52) U.S. Cl. ..... 148/519; 148/320

(58) Field of Classification Search ..... 148/909, 148/519, 593, 521, 520, 329
See application file for complete search history.

(56) References Cited

U.S. PATENT DOCUMENTS

| | | | | | |
|---|---|---|---|---|---|
| 2,693,632 | A * | 11/1954 | Heussner | 228/151 |
| 2,959,849 | A * | 11/1960 | Rubin | 29/417 |
| 4,162,758 | A * | 7/1979 | Mikarai | 228/131 |
| 6,331,216 | B1 * | 12/2001 | Toyooka et al. | 148/320 |
| 6,676,774 | B2 * | 1/2004 | Matsuoka et al. | 148/328 |

FOREIGN PATENT DOCUMENTS

| | | | |
|---|---|---|---|
| EP | 924312 | * | 3/2001 |
| JP | 4-143015 | * | 5/1992 |
| JP | 6-41689 | * | 2/1994 |

(Continued)

OTHER PUBLICATIONS

Texture of warm-reduced steel tube, Ysohikazu Kawabata (Technical Research Lab., Kawasaki Steel Corp. CAMP-ISIJ vol. 14(2001)-438.*

*Primary Examiner*—Roy King
*Assistant Examiner*—Jessee R. Roe
(74) *Attorney, Agent, or Firm*—DLA Piper LLP (US)

(57) ABSTRACT

A steel pipe is produced by a method including performing diameter-reducing rolling on a steel pipe in a temperature range of from 600° C. to $Ac_3$ with a reduction in diameter of not less than 30%, preferably after heating the steel pipe to temperatures of not lower than $Ac_1$, the steel pipe being produced by seam-welding strip steel, or a method further including the step of performing heat treatment of holding the rolled steel pipe in a temperature range of from 600° C. to 900° C. for a time of 1 second or longer during cooling subsequent to the diameter-reducing rolling or by reheating the rolled steel pipe after the cooling.

12 Claims, 3 Drawing Sheets

FOREIGN PATENT DOCUMENTS

| | | | |
|---|---|---|---|
| JP | 10-58161 | * | 3/1998 |
| JP | 10-175027 | * | 6/1998 |
| JP | 2000-212694 | * | 2/2000 |
| JP | 2000-96142 | * | 4/2000 |
| JP | 2000-096143 | * | 4/2000 |
| JP | 2000-96143 | * | 4/2000 |
| JP | 2001-162305 | * | 6/2001 |
| JP | 2001-214218 | * | 8/2001 |

* cited by examiner

HIGH-WORKABILITY STEEL PIPE AND METHOD OF PRODUCING SAME

TECHNICAL FIELD

This disclosure relates to a steel pipe having superior workability and a method of producing the steel pipe.

BACKGROUND

For the purpose of reducing the weight and cost, the application of seam (electric resistance) welded steel pipes to automobile parts has been considered. Conventional seam welded steel pipes, however, have not been sufficient in workability. Bending is employed to manufacture, e.g., undercarriage or suspension parts of automobiles. When the conventional seam welded steel pipes are subjected to the bending, a problem has been experienced in that a pipe wall is greatly thinned on the outer side of a bent portion, and in the worst case a pipe is ruptured. Even in the case of not causing a rupture, a large rate of thinning of the pipe wall requires the use of a material having a greater thickness to satisfy the design stress, and therefore a sufficient reduction in weight cannot be achieved.

As disclosed in Japanese Unexamined Patent Application Publication No. 55-56624, for example, it is known that improving an r-value (Lankford value) of a pipe in the axial direction is effective to overcome the problems described above. As a method for increasing the r-value of a steel pipe, however, it is only known to increase the r-value of strip steel as a base material of a steel pipe as disclosed in, for example, Japanese Unexamined Patent Application Publication No. 6-41689. When producing seam welded steel pipes, there has been a problem that the r-value is reduced in a portion where melting or transformation of a steel material has occurred during seam welding. Another problem has arisen in that the seam welding cannot be applied to steel plates not having a high r-value, such as hot-rolled steel plates, high tensile strength steel plates, and low, medium and high carbon steel plates.

Accordingly, it could be advantageous to provide a steel pipe being superior in workability, particularly in bending workability, in which an r-value of the pipe in the axial direction in a portion where melting or transformation of a steel material has occurred during seam welding is as high as comparable to that in a portion where melting or transformation of the steel material has not occurred, and a method of producing the steel pipe.

SUMMARY

With the view of overcoming the problems mentioned above, we conducted studies based on a consideration that working and heat treatment of seam welded steel pipes are required to improve the r-value in a welded portion near the seam. Then, we studied a method of performing working and heat treatment of a steel pipe evenly at any positions in the circumferential direction, the steel pipe being produced by seam-welding cold-rolled steel having a high r-value. We found that the r-value of the seam welded steel pipe in the longitudinal direction (in the axial direction of the pipe) is noticeably improved to 1.2 or above, in particular to 1.6 or above, at any positions in the circumferential direction, including a seamed portion, by a method of performing diameter-reducing rolling on the seam welded steel pipe in a temperature range of from 600° C. to $Ac_3$ with a reduction in diameter of not less than 30% (referred to as "the method" or "our method" hereinafter).

As a result of applying the method to seam welded steel pipes produced using various kinds of steel plates as base-material strip steel, we also found that a high r-value can be obtained regardless of the r-value of the original strip steel. Further, we found that with the method, the restriction of ingredients which has hitherto been employed to obtain a high r-value in steel sheets, i.e., a reduction of the C and N contents and addition of stabilizing elements such as Ti and Nb, are not required. As a result, seam welded steel pipes having a high r-value can also be produced using, as base-material strip steel, hot-rolled steel, high tensile strength steel such as dual phase steel, and low, medium and high carbon steel, which have a difficulty in achieving a high r-value in the stage of strip steel.

Our views regarding the reason why a steel pipe having a high r-value can be obtained from even a steel plate not having a high r-value are as follows.

By performing the diameter-reducing rolling on a seam welded steel pipe in a temperature range of from 600° C. to $Ac_3$ with a reduction in diameter of not less than 30%, an ideal aggregation structure due to the rolling, in which the <110> axis is parallel to the longitudinal direction and the <111 > to <110> axes are parallel to the radial direction, is formed and then further developed through restoration and recrystallization. That aggregation structure provides a high r-value. The aggregation structure due to the rolling produces very great driving forces because crystals are rotated by working strains. Unlike an aggregation structure that is created through recrystallization in the case of obtaining a high r-value in steel sheets, the aggregation structure due to the rolling is less affected by the second phase and solid solution C. Consequently, even for the type of strip steel which has a difficulty in obtaining a high r-value in the stage of producing steel plates, a high r-value can be obtained in the stage of producing steel pipes.

Also, the reason why a high r-value is not obtained by performing the diameter-reducing rolling at low temperatures is that ideal crystal rotation is not caused because of high work hardness, or that restoration and recrystallization are not developed at a sufficient level because of low temperatures. Furthermore, the reason why a high r-value is not obtained by a method of performing the diameter-reducing rolling on a steel pipe at low temperatures and then annealing the rolled steel pipe for recrystallization is that the desired aggregation structure is not developed through the cold rolling and the recrystallization because of the effect of the second phase and solid solution C.

In the field of producing steel sheets, there is known a method of producing a steel sheet having a high r-value by rolling steel into a sheet in the hot ferrite range. That method of producing a steel sheet having a high r-value is featured in that steel containing C and N in reduced amounts and added with stabilizing elements such as Ti and Nb is rolled at low temperatures and then recrystallized. That sheet rolling at low temperatures differs from the diameter-reducing rolling at high temperatures intended by our method. In fact, if the known sheet rolling in the hot ferrite range is carried out at 600° C. or above, the r-value is not improved, but rather noticeably lowered on the contrary. This is because, in the sheet rolling in which draft is applied in the thickness direction of a sheet, strain occurs in a direction different from that in the diameter-reducing rolling of a steel pipe in which draft is applied in the circumferential direction, and hence the aggregation structure effective in increasing the r-value is not developed.

As a result of further continuing the studies, we found that, in our method, the thickness deviation can be noticeably reduced and the occurrence of wrinkles near the seam can be suppressed by heating a seam welded steel pipe to temperatures of not lower than $Ac_1$ before the diameter-reducing rolling for austenitic transformation of a part or the whole of a steel structure, because the difference in mechanical properties between the hardened structure of the seam and the remaining portion is reduced. We therefore provide:

(1) A high-workability steel pipe wherein an r-value in the longitudinal direction is not less than 1.2, more preferably not less than 1.6, over an entire area in the circumferential direction, including a seamed portion.

(2) A method of producing a high-workability steel pipe, the method comprising the step of performing diameter-reducing rolling on a steel pipe in a temperature range of from 600° C. to $Ac_3$ with a reduction in diameter of not less than 30%, the steel pipe being produced by seam-welding strip steel.

(3) A method of producing a high-workability steel pipe, the method comprising the steps of heating a steel pipe to temperatures of not lower than $Ac_1$, the steel pipe being produced by seam-welding strip steel, and then immediately or after cooling and reheating the steel pipe, performing diameter-reducing rolling in a temperature range of from 600° C. to $Ac_3$ with a reduction in diameter of not less than 30%.

(4) In the method of producing a high-workability steel pipe defined in the above (2) or (3), after the diameter-reducing rolling of the steel pipe, heat treatment of holding the rolled steel pipe in a temperature range of from 600° C. to 900° C. for a time of 1 second or longer is performed during cooling subsequent to the diameter-reducing rolling or by reheating the rolled steel pipe after the cooling.

DETAILED DESCRIPTION

In our high-workability steel pipe, an r-value in the longitudinal direction is not less than 1.2. The reason is that the bending workability of the steel pipe is noticeably improved when the r-value is not less than 1.2. More preferably, the high-workability steel pipe has an r-value of not less than 1.6 because the bending workability is further improved when the r-value is not less than 1.6.

The high-workability steel pipe can be produced by performing diameter-reducing rolling on a steel pipe in a temperature range of from 600° C. to $Ac_3$ with a reduction in diameter of not less than 30%, the steel pipe being produced by seam-welding strip steel and having a seam. The r-value is affected by the reduction in diameter and the temperature during the diameter-reducing rolling.

Figure 1:
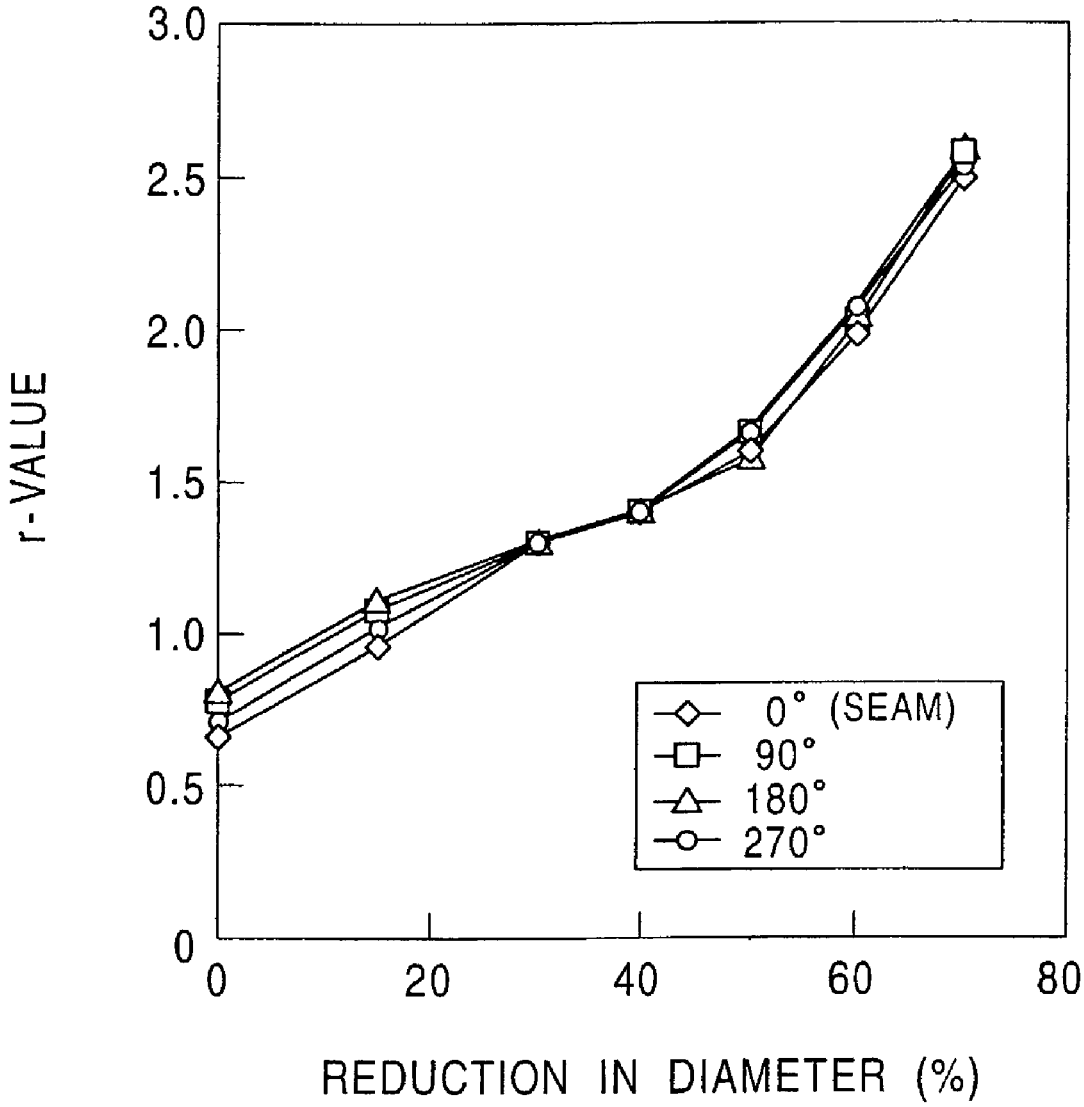
FIG. 1 is a graph showing the relationship between an r-value in the longitudinal direction of a steel pipe having been subjected to diameter-reducing rolling and a reduction in diameter.

FIG. 1 is a graph showing the relationship between the r-value in the longitudinal direction and the reduction in diameter at circumferential positions 0°, 90°, 180° and 270° of each steel pipe which was produced by performing the diameter-reducing rolling on a seam welded steel pipe under a condition of the outgoing-side temperature being set to 730° C. while changing the reduction in diameter of the seam welded steel pipe from that produced by an ordinary method from strip steel having the same composition as steel A in Table 1 given below. The seam position is assumed to be at 0° (this is similarly applied to the following description). From FIG. 1, it is understood that, regardless of the circumferential positions, the r-value of not less than 1.3 is obtained at the reduction in diameter of not less than 30%, and the r-value of not less than 1.6 is obtained at the reduction in diameter of not less than 50%.

Figure 2:
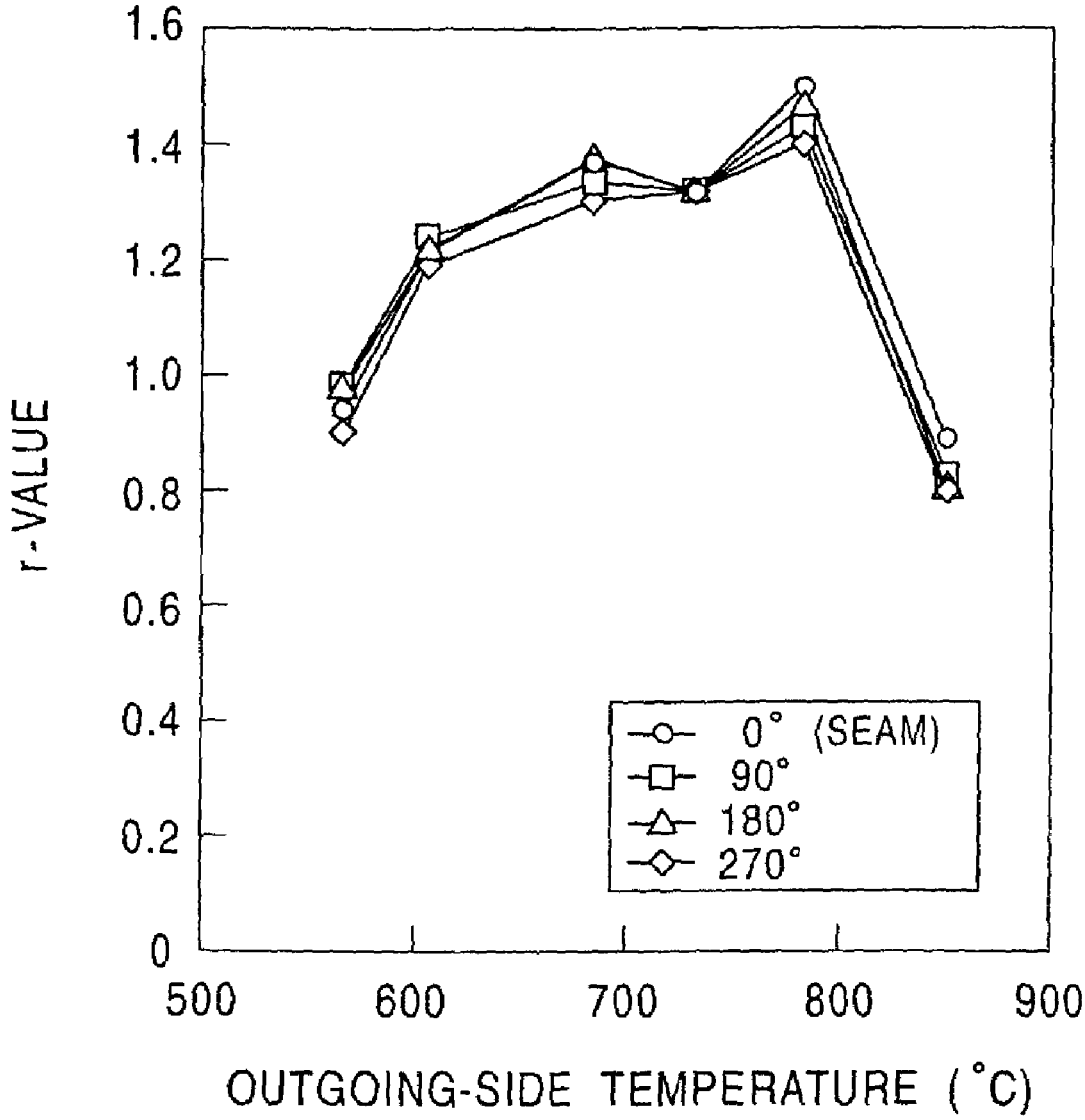
FIG. 2 is a graph showing the relationship between an r-value in the longitudinal direction of a steel pipe having been subjected to diameter-reducing rolling and an outgoing-side temperature in the rolling process.

FIG. 2 is a graph showing the relationship between the r-value in the longitudinal direction and the outgoing-side temperature resulted at circumferential positions 0°, 90°, 180° and 270° of each steel pipe which was produced by performing the diameter-reducing rolling on a seam welded steel pipe under a condition of the reduction in diameter set to 30% while changing the outgoing-side temperature, the seam welded steel pipe being produced by an ordinary method from strip steel having the same composition as steel A in Table 1 given below. From FIG. 2, it is understood that the r-value of not less than 1.2 is obtained at the outgoing-side temperature of not lower than 600° C.

Based on the experiment results mentioned above, a lower limit of the temperature for the diameter-reducing rolling was set to 600° C. and a lower limit of the reduction in diameter was set to 30%. Also, an upper limit of the temperature for the diameter-reducing rolling was set to the same as an upper limit of the temperature range in which the steel structure contains ferrite, i.e., the temperature $Ac_3$. The r-value is not improved even by the diameter-reducing rolling if it is performed on steel whose structure contains no ferrite. The temperature $Ac_3$ depends on the chemical composition of steel, and can be determined based on experiments. A range of temperature $Ac_3$ is approximately not higher than 900° C. So long as the steel structure contains ferrite, the second phase (phase other than ferrite) is not limited to particular one. For example, austenite may be the second phase. More preferably, the diameter-reducing rolling is performed at temperatures where ferrite forms the main phase (phase having a volume ratio of 50% or more).

We subject a steel pipe to the diameter-reducing rolling in a temperature range where the steel structure has the ferrite phase. From the standpoint of improving the r-value, there is no particular restriction upon the history prior to the diameter-reducing rolling. For example, the heating temperature prior to the diameter-reducing rolling may be any of the temperature at which the steel structure has the single austenitic phase, the temperature at which the steel structure has the two austenitic and ferrite phases, and the temperature at which the steel structure has the single ferrite phase. Further, prior to the diameter-reducing rolling, the steel pipe may be rolled at such temperatures as forming austenite as the single phase or the main phase.

Figure 3:
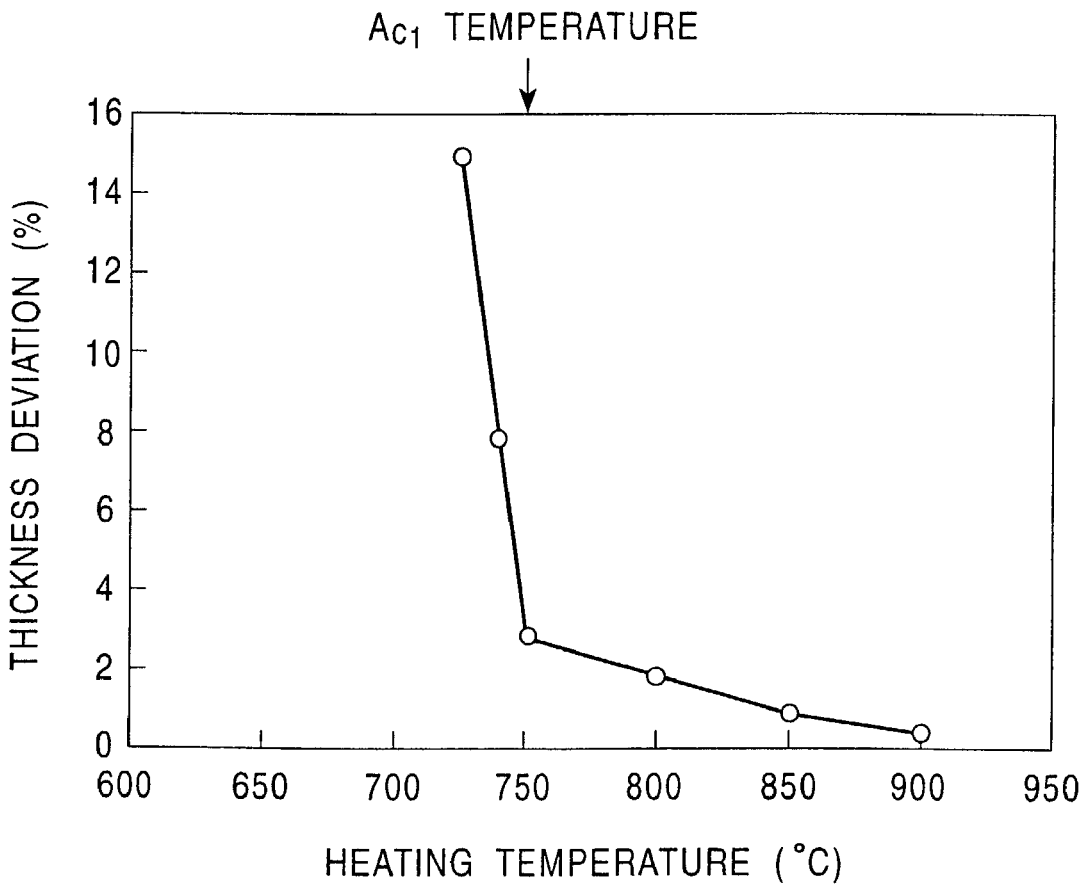
FIG. 3 is a graph showing the relationship between a seam thickness deviation in a steel pipe having been subjected to diameter-reducing rolling and a heating temperature before the diameter-reducing rolling.

FIG. 3 is a graph showing the relationship between a heating temperature and a thickness deviation resulted for each steel pipe which was produced by performing the diameter-reducing rolling on a seam welded steel pipe under conditions of the reduction in diameter set to 30% and the rolling temperature set to 700° C. while changing the heating temperature, the seam welded steel pipe being produced by an ordinary method from strip steel having the same composition as steel A in Table 1 given below. From FIG. 3, it is understood that the heating prior to the diameter-reducing rolling is preferably set to be not lower than the temperature $Ac_1$ from the standpoint of suppressing the thickness deviation and wrinkles occurred near the seam. The temperature $Ac_1$ depends on the chemical composition of the steel pipe, etc., and can be determined based on experiments. A range of temperature $Ac_1$ is approximately not lower than 800° C. However, if the heating temperature is too high, the crystal grain size would be excessively increased, thus resulting in a problem of, for example, increasing surface roughness during the working. For that reason, the heating temperature is preferably set to be not higher than 900° C.

There is no particular restriction upon the cooling after the heating of the steel pipe. Subsequent to the heating, the diameter-reducing rolling may be performed, for example, after cooling the steel pipe down to temperatures at which ferrite forms the main phase, or by reheating the steel pipe after cooling it down to the room temperature.

Further, preferably, after the diameter-reducing rolling of the steel pipe, heat treatment of holding the rolled steel pipe in a temperature range of from 600° C. to 900° C. for a time of 1 second or longer is performed.

Since the diameter-reducing rolling is performed at temperatures of not lower than 600° C., the work hardness is low and a sufficient level of workability is obtained with additional treatment. Even so, by performing heat treatment for holding the rolled steel pipe at a certain temperature for a certain time in succession to the diameter-reducing rolling, the elongation and the r-value are further improved. This effect is developed by holding the rolled steel pipe at temperatures of not lower than 600° C. for a time of 1 second or longer. However, if the holding temperature exceeds 900° C., the steel structure would be transformed into the single austenitic phase and the r-value would be reduced because of the randomized aggregation structure. For that reason, the heat treatment is preferably performed on conditions of the holding temperature in the range of from 600° C. to 900° C. and the holding time of 1 second or longer. Additionally, the heat treatment may be performed during cooling subsequent to the diameter-reducing rolling or by reheating the rolled steel pipe after the cooling.

EXAMPLE

Seam welded steel pipes were produced by an ordinary method from various kinds of hot-rolled steel plates having chemical compositions shown in Table 1, and the diameter-reducing rolling was performed on each steel pipe under conditions shown in Table 2. Heating of the steel pipe prior to the diameter-reducing rolling was not held at all or held for a time of 1 to 600 seconds after reaching the temperature shown in Table 2. Tensile specimens of JIS No. 12-A were sampled from circumferential positions 0°, 90°, 180° and 270° of each steel pipe obtained. After bonding a strain gauge with a gauge length of 2 mm to each specimen, a tensile test was carried out on the specimen by applying a nominal strain of 6 to 7%. Then, a ratio of a true strain $\epsilon_w$ in the width direction to a true strain $\epsilon_L$ in the longitudinal direction was measured. From a gradient ρ of that ratio, the r-value was calculated based on the following formulae:

$$\rho=\epsilon_L/\epsilon_w$$

$$\text{r-value}=\rho/(-1-\rho)$$

Further, a thickness deviation η was calculated by measuring a pipe wall thickness ts of a seamed portion and an average pipe wall thickness tb of the remaining portion. That is:

$$\text{thickness deviation } \eta\%=(ts-tb)/tb\times 100\%$$

Moreover, the presence or absence of wrinkles was determined by observing an image of an area near the seam in a cross-section perpendicular to the axis of the steel pipe, the image being enlarged at a magnification of 50 times.

Those results are listed in Table 3 along with the tensile strength (TS) and the elongation (E1).

The r-value is 1.2 or above at any positions in the circumferential direction in our Examples, whereas the r-value is below 1.2 in Comparative Examples. Also, in the specimens heated to temperatures of not lower than $Ac_1$, the thickness deviation is smaller and wrinkles are not caused.

INDUSTRIAL APPLICABILITY

A high-workability steel pipe can be provided which has a high r-value over an entire area in the circumferential direction, including a seamed portion, and also has a good shape. Limits in bending and expanding work of the steel pipe are noticeably improved, whereby omission of steps due to the integral forming and a reduction in weight can be achieved. Further, seam welded steel pipes having a high r-value can also be produced using, as base materials, hot-rolled steel, high tensile strength steel such as dual phase steel, and low, medium and high carbon steel, which have a difficulty in achieving a high r-value with a conventional method of producing a steel pipe by simply seam-welding a steel plate. As a result, we are able to remarkably enlarge the applicable range of bending of steel pipes and hence greatly contributes to development of the industry.

TABLE 1

| | Chemical Composition (&) | | | | | | | | | | | | | $Ac_1$ | $Ac_3$ |
|---|---|---|---|---|---|---|---|---|---|---|---|---|---|---|---|
| Steel | C | Si | Mn | P | S | Al | N | Cr | Ti | Nb | B | Ni | Cu | (° C.) | (° C.) |
| A | 0.06 | 0.1 | 0.3 | 0.01 | 0.005 | 0.02 | 0.003 | — | — | — | — | — | — | 730 | 840 |
| B | 0.1 | 0.2 | 0.8 | 0.01 | 0.005 | 0.02 | 0.003 | — | — | — | — | — | — | 730 | 820 |
| C | 0.25 | 0.3 | 0.8 | 0.01 | 0.005 | 0.02 | 0.003 | — | — | — | — | — | — | 750 | 800 |
| D | 0.25 | 0.3 | 0.5 | 0.01 | 0.005 | 0.02 | 0.003 | — | — | — | 0.002 | — | — | 750 | 800 |
| E | 0.4 | 0.3 | 1.6 | 0.01 | 0.005 | 0.02 | 0.003 | 0.03 | — | — | — | — | — | 730 | 780 |
| F | 0.08 | 1.0 | 1.4 | 0.01 | 0.005 | 0.02 | 0.003 | 0.9 | 0.01 | — | — | — | — | 750 | 840 |
| G | 0.15 | 1.4 | 1.5 | 0.01 | 0.005 | 0.02 | 0.003 | 0.3 | — | — | — | — | — | 770 | 820 |
| H | 0.08 | 0.5 | 1.2 | 0.01 | 0.005 | 0.02 | 0.003 | — | 0.04 | — | — | — | — | 770 | 820 |
| I | 0.08 | 0.04 | 1.5 | 0.01 | 0.005 | 0.02 | 0.003 | — | 0.04 | — | — | — | — | 750 | 800 |
| J | 0.08 | 1.5 | 1.8 | 0.01 | 0.005 | 0.02 | 0.003 | — | 0.1 | — | — | — | — | 780 | 830 |
| K | 0.09 | 0.05 | 1.8 | 0.01 | 0.005 | 0.02 | 0.003 | — | 0.15 | 0.05 | — | — | — | 750 | 800 |
| L | 0.01 | 0.2 | 1.5 | 0.01 | 0.005 | 0.02 | 0.003 | 11.0 | — | — | — | 0.25 | 0.4 | 730 | 800 |

TABLE 2

| No. | Steel | Heating Temperature (° C.) | Incoming-side Temperature in Diameter-Reducing Rolling (° C.) | Outgoing-side Temperature in Diameter-Reducing Rolling (° C.) | Total Reduction in Diameter (%) | Effective Reduction in Diameter* (%) | Heat Treatment | Remarks |
|---|---|---|---|---|---|---|---|---|
| 1 | A | 800 | 780 | 730 | 50 | 50 | — | Example |
| 2 | A | 900 | 880 | 830 | 50 | 5 | — | Comparative Example |
| 3 | A | 630 | 610 | 560 | 50 | 10 | — | Comparative Example |
| 4 | B | 800 | 780 | 730 | 50 | 50 | — | Example |
| S | B | 800 | 780 | 730 | 50 | 50 | — | Example |
| 6 | C | 800 | 780 | 730 | 50 | 50 | 730° C. × 5 min. | Example |
| 7 | D | 900** | 720 | 680 | 50 | 50 | — | Example |
| 8 | D | 850 | 720 | 680 | 50 | 50 | — | Example |
| 9 | D | 800 | 780 | 730 | 50 | 50 | — | Example |
| 10 | D | 800 | 720 | 680 | 50 | 50 | — | Example |
| 11 | D | 750 | 720 | 680 | 50 | 50 | — | Example |
| 12 | D | 735 | 720 | 680 | 50 | 50 | — | Example |
| 13 | D | 720 | 720 | 680 | 50 | 50 | — | Example |
| 14 | E | 800 | 780 | 730 | 50 | 50 | — | Example |
| 15 | F | 800 | 780 | 730 | 0 | 0 | — | Comparative Example |
| 16 | F | 800 | 780 | 730 | 15 | 15 | — | Comparative Example |
| 17 | F | 800 | 780 | 730 | 30 | 30 | — | Example |
| 18 | F | 800 | 780 | 730 | 40 | 40 | — | Example |
| 19 | F | 800 | 780 | 730 | 50 | 50 | — | Example |
| 20 | F | 800 | 780 | 730 | 60 | 60 | — | Example |
| 21 | F | 800 | 780 | 730 | 70 | 70 | — | Example |
| 22 | F | 900 | 890 | 850 | 30 | 2 | — | Comparative Example |
| 23 | F | 850 | 840 | 780 | 30 | 30 | — | Example |
| 24 | F | 750 | 730 | 680 | 30 | 30 | — | Example |
| 25 | F | 700 | 680 | 600 | 30 | 30 | — | Example |
| 26 | F | 630 | 610 | 560 | 50 | 10 | — | Comparative Example |
| 27 | G | 900 | 780 | 730 | 50 | 50 | — | Example |
| 28 | G | 850 | 780 | 730 | 50 | 50 | — | Example |
| 29 | G | 800 | 780 | 730 | 30 | 30 | — | Example |
| 30 | G | 800 | 780 | 730 | 40 | 40 | — | Example |
| 31 | G | 800 | 780 | 730 | 50 | 50 | — | Example |
| 32 | H | 800 | 780 | 730 | 50 | 50 | — | Example |
| 33 | I | 800 | 780 | 730 | 50 | 50 | — | Example |
| 34 | J | 800 | 780 | 730 | 50 | 50 | — | Example |
| 35 | K | 800 | 780 | 730 | 50 | 50 | — | Example |
| 36 | L | 760 | 740 | 700 | 60 | 60 | — | Example |

*effective reduction in diameter: reduction in diameter in temperature range of 600° C. to $Ac_3$
**rolling after cooling and reheating (for other types of steel, rolling immediately after heating)

TABLE 3

| | 0° (Seam) | | | 90° | | | 180° | | | 270° | | | Seam Thickness | Wrinkles ○ not occurred | |
|---|---|---|---|---|---|---|---|---|---|---|---|---|---|---|---|
| No | TS/ Mpa | EI* /% | r-value | TS/ Mpa | EI* /% | r-value | TS/ Mpa | EI* /% | r-value | TS/ Mpa | EI* /% | r-value | Deviation /% | x occurred | Remarks |
| 1 | 300 | 55 | 2.0 | 303 | 54 | 2.0 | 307 | 54 | 2.1 | 301 | 55 | 2.1 | 0.3 | ○ | Example |
| 2 | 300 | 45 | 0.8 | 309 | 45 | 0.9 | 307 | 45 | 0.8 | 308 | 45 | 0.8 | 0.3 | ○ | Comparative Example |
| 3 | 450 | 35 | 1.0 | 450 | 35 | 1.1 | 459 | 36 | 1.0 | 451 | 34 | 1.1 | 10.0 | X | Comparative Example |
| 4 | 350 | 50 | 2.0 | 356 | 51 | 2.0 | 356 | 50 | 2.0 | 350 | 51 | 2.0 | 0.5 | ○ | Example |
| 5 | 350 | 50 | 2.4 | 358 | 51 | 2.4 | 351 | 49 | 2.5 | 356 | 49 | 2.4 | 0.5 | ○ | Example |
| 6 | 620 | 25 | 1.8 | 624 | 24 | 1.8 | 625 | 25 | 1.8 | 629 | 25 | 1.9 | 0.3 | ○ | Example |
| 7 | 640 | 27 | 1.7 | 646 | 27 | 1.7 | 641 | 27 | 1.7 | 647 | 26 | 1.7 | 0.5 | ○ | Example |
| 8 | 631 | 25 | 1.7 | 651 | 26 | 1.6 | 641 | 25 | 1.8 | 641 | 25 | 1.8 | 1.0 | ○ | Example |
| 9 | 620 | 28 | 1.8 | 626 | 29 | 1.8 | 621 | 29 | 1.9 | 627 | 28 | 1.9 | 0.5 | ○ | Example |
| 10 | 640 | 24 | 1.6 | 659 | 24 | 1.7 | 632 | 24 | 1.7 | 636 | 24 | 1.7 | 2.0 | ○ | Example |
| 11 | 644 | 22 | 1.6 | 650 | 22 | 1.7 | 635 | 22 | 1.7 | 632 | 22 | 1.8 | 30 | ○ | Example |
| 12 | 653 | 20 | 1.6 | 657 | 21 | 1.6 | 640 | 21 | 1.8 | 623 | 21 | 1.8 | 8.0 | x | Example |
| 13 | 644 | 19 | 1.7 | 650 | 19 | 1.7 | 637 | 19 | 1.9 | 614 | 19 | 1.8 | 15.0 | x | Example |

TABLE 3-continued

| | 0° (Seam) | | | 90° | | | 180° | | | 270° | | | Seam Thickness | Wrinkles ○ not occurred | |
|---|---|---|---|---|---|---|---|---|---|---|---|---|---|---|---|
| No | TS/ Mpa | EI* /% | r-value | TS/ Mpa | EI* /% | r-value | TS/ Mpa | EI* /% | r-value | TS/ Mpa | EI* /% | r-value | Deviation /% | x occurred | Remarks |
| 14 | 650 | 25 | 1.8 | 652 | 25 | 1.9 | 651 | 25 | 1.8 | 651 | 26 | 1.9 | 0.5 | ○ | Example |
| 15 | 500 | 25 | 0.7 | 508 | 26 | 0.8 | 503 | 24 | 0.8 | SOl | 25 | 0.8 | 0.3 | ○ | Comparative Example |
| 16 | 590 | 28 | 1.0 | 593 | 28 | 1.1 | 599 | 29 | 1.1 | 595 | 28 | 1.0 | 0.3 | ○ | Comparative Example |
| 17 | 610 | 28 | 1.3 | 610 | 28 | 1.3 | 618 | 28 | 1.3 | 614 | 29 | 1.3 | 0.9 | ○ | Example |
| 18 | 610 | 29 | 1.4 | 619 | 29 | 1.4 | 611 | 30 | 1.4 | 611 | 28 | 1.4 | 0.9 | ○ | Example |
| 19 | 610 | 30 | 1.6 | 617 | 31 | 1.7 | 611 | 30 | 1.6 | 61S | 31 | 1.6 | 0.9 | ○ | Example |
| 20 | 610 | 32 | 2.0 | 616 | 31 | 2.0 | 612 | 33 | 2.1 | 610 | 31 | 2.1 | 0.9 | ○ | Example |
| 21 | 610 | 35 | 2.5 | 615 | 35 | 2.6 | 613 | 36 | 2.6 | 618 | 36 | 2.6 | 0.8 | ○ | Example |
| 22 | 590 | 28 | 0.8 | 593 | 27 | 0.8 | 599 | 28 | 0.8 | 593 | 28 | 0.9 | 0.2 | ○ | Comparative Example |
| 23 | 610 | 29 | 1.4 | 612 | 30 | 1.4 | 614 | 30 | 1.5 | 616 | 29 | 1.5 | 0.2 | ○ | Example |
| 24 | 610 | 28 | 1.3 | 613 | 29 | 1.3 | 615 | 28 | 1.4 | 612 | 28 | 1.4 | 0.0 | ○ | Example |
| 25 | 650 | 27 | 1.2 | 651 | 26 | 1.2 | 650 | 27 | 1.2 | 658 | 26 | 1.2 | 3.0 | x | Example |
| 26 | 630 | 22 | 0.9 | 680 | 21 | 1.0 | 687 | 22 | 1.0 | 685 | 23 | 0.9 | 15.0 | x | Comparative Example |
| 27 | 630 | 30 | 1.3 | 638 | 30 | 1.3 | 639 | 31 | 1.4 | 640 | 31 | 1.3 | 0.7 | ○ | Example |
| 28 | 630 | 33 | 1.4 | 636 | 33 | 1.4 | 630 | 33 | 1.5 | 638 | 33 | 1.5 | 0.5 | ○ | Example |
| 29 | 630 | 30 | 1.3 | 638 | 30 | 1.3 | 639 | 31 | 1.4 | 640 | 31 | 1.3 | 0.3 | ○ | Example |
| 30 | 630 | 33 | 1.4 | 636 | 33 | 1.4 | 630 | 33 | 1.5 | 638 | 33 | 1.5 | 0.3 | ○ | Example |
| 31 | 630 | 35 | 1.8 | 637 | 34 | 1.9 | 635 | 35 | 1.8 | 633 | 34 | 1.9 | 0.4 | ○ | Example |
| 32 | 600 | 30 | 1.8 | 606 | 30 | 1.8 | 609 | 30 | 1.9 | 600 | 30 | 1.8 | 0.5 | ○ | Example |
| 33 | 600 | 30 | 1.8 | 604 | 29 | 1.8 | 605 | 31 | 1.9 | 601 | 29 | 1.9 | 0.8 | ○ | Example |
| 34 | 820 | 24 | 1.6 | 823 | 25 | 1.6 | 821 | 25 | 1.7 | 825 | 24 | 1.7 | 0.3 | ○ | Example |
| 35 | 820 | 22 | 1.6 | 821 | 22 | 1.6 | 823 | 23 | 1.7 | 830 | 22 | 1.7 | 0.8 | ○ | Example |
| 36 | 695 | 28 | 1.8 | 595 | 28 | 1.8 | 595 | 28 | 1.8 | 595 | 28 | 1.8 | 0.3 | ○ | Example |

*sheet thickness = 1.6 mm

The invention claimed is:

1. A method of producing a high-workability steel pipe comprising:

seam-welding strip steel into a steel pipe;

heating the steel pipe to temperatures of more than $Ac_3$; and immediately or after cooling and reheating said steel pipe, performing diameter-reducing rolling of the steel pipe in a temperature range of from 700° C. to $Ac_3$ with a reduction in diameter of the steel pipe of not less than 30% such that the pipe and a weld in the pipe have an r-value of 1.3 or more.

2. The method of producing a high-workability steel pipe according to claim 1, wherein after the diameter-reducing rolling of said steel pipe, heat treatment of holding the rolled steel pipe in a temperature range of from 600° C. to 900° C. for a time of 1 second or longer is performed during cooling subsequent to the diameter-reducing rolling or by reheating the rolled steel pipe after said cooling.

3. The method according to claim 1, wherein heating the steel pipe is at $Ac_3$ to 900° C.

4. The method according. to claim 1, wherein the $Ac_3$ temperature is 840° C.

5. A method of producing a high-workability steel pipe comprising:

seam-welding steel strip into a steel pipe;

heating the steel pipe to temperatures of more than $Ac_3$; and immediately after heating the steel pipe, performing diameter-reducing rolling of the steel pipe in a temperature range of from 700° C. to $Ac_3$ with a reduction in diameter of the steel pipe of not less than 30% such that the pipe and a weld in the pipe have an r-value of 1.3 or more.

6. The method according to claim 5, further comprising:

after diameter-reducing rolling the steel pipe, performing a heat treatment of holding the rolled steel pipe in a temperature range of from 600° C. to 900° C. for a time of one second or longer.

7. The method of according to claim 5, wherein heating the steel pipe is at $Ac_3$ to 900° C.

8. The method according to claim 5, wherein the $Ac_3$ temperature is 840° C.

9. A method of producing a high-workability steel pipe comprising:

seam-welding steel strip into a steel pipe;

heating the steel pipe to temperatures of more than $Ac_3$;

cooling the heated steel pipe;

reheating the cooled steel pipe; and performing diameter-reducing rolling of the steel pipe in a temperature range of from 700° C. to $Ac_3$ with a reduction in diameter of the steel pipe of not less than 30% such that the pipe and a weld in the pipe have an r-value of 1.3 or more.

10. The method according to claim 9, further comprising:

after diameter-reducing rolling the steel pipe, performing a heat treatment of holding the rolled steel pipe in a temperature range of from 600° C. to 900° C. for a time of one second or longer.

11. The method according to claim 9, wherein heating the steel pipe is at $Ac_3$ to 900° C.

12. The method according to claim 9, wherein the $Ac_3$ temperature is 840° C.

* * * * *

UNITED STATES PATENT AND TRADEMARK OFFICE

CERTIFICATE OF CORRECTION

PATENT NO. : 7,591,914 B2
APPLICATION NO. : 10/258982
DATED : September 22, 2009
INVENTOR(S) : Toyooka et al.

It is certified that error appears in the above-identified patent and that said Letters Patent is hereby corrected as shown below:

In Column 10
At Table 3-continued, at No. 15, at the sub-heading "TS/Mpa", please change "SO1" to --501--.

Signed and Sealed this

Twenty-third Day of February, 2010

David J. Kappos

David J. Kappos
*Director of the United States Patent and Trademark Office*